US007882593B2

(12) United States Patent
Beskow et al.

(10) Patent No.: US 7,882,593 B2
(45) Date of Patent: Feb. 8, 2011

(54) DIRT SEPARATOR SYSTEM FOR A VACUUM CLEANER

(75) Inventors: Jonas Beskow, Stockholm (SE); Håkan Miefalk, Järfälla (SE); Ulrik Danestad, Huddinge (SE)

(73) Assignee: AB Electrolux, Stockholm (SE)

( * ) Notice: Subject to any disclaimer, the term of this patent is extended or adjusted under 35 U.S.C. 154(b) by 0 days.

(21) Appl. No.: 12/523,649

(22) PCT Filed: Jan. 18, 2008

(86) PCT No.: PCT/SE2008/000043

§ 371 (c)(1),
(2), (4) Date: Dec. 7, 2009

(87) PCT Pub. No.: WO2008/088278

PCT Pub. Date: Jul. 24, 2008

(65) Prior Publication Data

US 2010/0083459 A1 Apr. 8, 2010

(30) Foreign Application Priority Data

Jan. 19, 2007 (SE) ..... 0700143

(51) Int. Cl.
*A47L 9/16* (2006.01)

(52) U.S. Cl. ..... 15/353; 15/347

(58) Field of Classification Search ..... 15/350, 15/352, 353, 328, 347; 55/337, 428, 429, 55/DIG. 3

See application file for complete search history.

(56) References Cited

U.S. PATENT DOCUMENTS 2,707,792 A 5/1955 Waller
2,863,524 A 12/1958 Buda
3,199,138 A 8/1965 Nordeen
3,621,640 A 11/1971 Ohno et al.
3,653,189 A 4/1972 Miyake et al.
3,906,219 A 9/1975 Stauffer
4,213,224 A 7/1980 Miller
4,276,070 A 6/1981 Hug
4,376,322 A 3/1983 Lockhart et al.
4,421,964 A 12/1983 Buchtel
4,467,493 A 8/1984 Buchtel (Continued)

FOREIGN PATENT DOCUMENTS

CA 2087056 7/1994

(Continued)

OTHER PUBLICATIONS

"The BOSS, Heavy Duty Rechargeable Vacuum, Model 98," Eureka brochure dated 1998, 2 pages.

(Continued)

*Primary Examiner*—Dung Van Nguyen
(74) *Attorney, Agent, or Firm*—Hunton & Williams

(57) ABSTRACT

A vacuum cleaner having an elongated support body, a nozzle attached to a lower end of the elongated support body by an articulated joint, a motor, a fan unit, a debris container, and an air passage that extends from the nozzle device, past the articulated joint by a flexible hose and to an air passage in the support body. The flexible hose is formed with a generally rectangular cross section.

21 Claims, 8 Drawing Sheets

U.S. PATENT DOCUMENTS 4,541,142 A 9/1985 Pudwill
4,545,089 A 10/1985 Oxel
4,573,234 A 3/1986 Kochte et al.
4,573,237 A 3/1986 Kochte et al.
4,621,390 A 11/1986 Hampton et al.
4,635,315 A 1/1987 Kozak
4,665,582 A 5/1987 Richmond et al.
4,670,701 A 6/1987 Sako et al.
4,704,765 A 11/1987 Ataka
4,748,713 A 6/1988 Sepke et al.
4,766,638 A 8/1988 McDowell
4,787,923 A 11/1988 Fleigle et al.
4,804,481 A 2/1989 Lennartz
D300,214 S 3/1989 Adams
4,821,366 A 4/1989 Levine
4,831,685 A 5/1989 Bosyj et al.
4,841,594 A 6/1989 Elson et al.
D304,104 S 10/1989 Busalt et al.
4,876,763 A 10/1989 Cho et al.
4,894,882 A 1/1990 Toya
4,899,418 A 2/1990 Steiner et al.
D307,657 S 5/1990 Li
4,920,606 A 5/1990 Gerke, Jr. et al.
4,920,608 A 5/1990 Hult et al.
4,928,346 A 5/1990 Elson et al.
4,934,020 A 6/1990 Jackson
4,942,641 A 7/1990 Gerke, Jr. et al.
4,947,514 A 8/1990 Gerke, Jr. et al.
4,967,443 A 11/1990 Krasznai et al.
4,993,106 A 2/1991 Hult et al.
5,005,252 A 4/1991 Steiner et al.
5,020,187 A 6/1991 Kosten et al.
5,025,529 A 6/1991 Hult et al.
5,035,024 A 7/1991 Steiner et al.
5,065,473 A 11/1991 Krasznai et al.
5,107,567 A 4/1992 Ferrari et al.
5,309,600 A 5/1994 Weaver et al.
5,322,534 A 6/1994 Kaiser
5,342,433 A 8/1994 Avondoglio
D352,807 S 11/1994 Sanderud
D364,013 S 11/1995 Klingspor et al.
5,524,321 A 6/1996 Weaver et al.
5,561,885 A 10/1996 Zahuranec et al.
5,584,095 A 12/1996 Redding et al.
5,603,740 A 2/1997 Roy
5,661,885 A 9/1997 Donato
5,715,566 A 2/1998 Weaver et al.
5,733,351 A 3/1998 Hult et al.
5,819,364 A 10/1998 Sham
5,869,947 A 2/1999 Zahuranec et al.
5,966,774 A 10/1999 Bone et al.
6,029,313 A 2/2000 O'Dea et al.
6,094,775 A 8/2000 Behmer
6,108,864 A 8/2000 Thomas et al.
6,122,796 A 9/2000 Downham et al.
6,125,498 A 10/2000 Roberts et al.
6,131,239 A 10/2000 White
6,146,434 A 11/2000 Scalfani et al.
6,189,178 B1 2/2001 Roberts
6,311,366 B1 11/2001 Sepke et al.
6,324,714 B1 12/2001 Walz et al.
6,428,589 B1 8/2002 Bair et al.
6,434,785 B1 8/2002 Vandenbelt et al.
6,546,592 B1 4/2003 Cockburn et al.
6,562,093 B2 * 5/2003 Oh ..... 55/337
6,571,421 B1 6/2003 Sham et al.
6,625,845 B2 9/2003 Matsumoto et al.
6,647,587 B1 11/2003 Ohara et al.
6,658,693 B1 12/2003 Reed, Jr.
6,736,873 B2 5/2004 Conrad et al.
6,766,558 B1 * 7/2004 Matsumoto et al. ..... 15/353
6,775,882 B2 8/2004 Murphy et al.
6,811,584 B2 11/2004 Oh
6,824,580 B2 11/2004 Oh
6,839,934 B2 1/2005 Houghton et al.
6,857,165 B2 2/2005 Oh
6,928,690 B2 8/2005 Ji
6,948,211 B2 9/2005 Stephens et al.
6,964,082 B2 11/2005 Hsu
6,968,596 B2 11/2005 Oh et al.
7,377,007 B2 5/2008 Best
7,383,609 B2 6/2008 Ji
7,386,916 B2 6/2008 Bone
7,404,838 B1 7/2008 Pathak
7,412,749 B2 8/2008 Thomas et al.
7,507,269 B2 * 3/2009 Murphy et al. ..... 55/337
2002/0042969 A1 4/2002 Nagai et al.
2002/0073504 A1 6/2002 Hall et al.
2002/0189048 A1 12/2002 Maruyama et al.
2003/0019073 A1 1/2003 Oh
2003/0159235 A1 8/2003 Oh
2003/0163887 A1 9/2003 Inoue
2003/0208879 A1 11/2003 Oh et al.
2003/0213091 A1 11/2003 Oh et al.
2004/0040270 A1 * 3/2004 Inoue et al. ..... 55/345
2004/0098957 A1 5/2004 Yoo et al.
2004/0103496 A1 6/2004 Worwag
2004/0134022 A1 7/2004 Murphy et al.
2004/0177471 A1 9/2004 Jung et al.
2004/0187253 A1 9/2004 Jin et al.
2004/0200029 A1 10/2004 Jin et al.
2004/0216263 A1 11/2004 Best
2004/0261212 A1 12/2004 Park et al.
2004/0261213 A1 12/2004 Park et al.
2005/0005390 A1 1/2005 Lee et al.
2005/0005391 A1 1/2005 Park
2005/0081321 A1 4/2005 Milligan et al.
2005/0125939 A1 6/2005 Hansen et al.
2005/0125940 A1 6/2005 McDowell
2005/0183406 A1 8/2005 Coburn
2006/0064828 A1 3/2006 Stein et al.
2006/0156508 A1 7/2006 Khalil
2007/0163075 A1 7/2007 Butler et al.
2007/0226946 A1 10/2007 Best

FOREIGN PATENT DOCUMENTS

CN 1272873.X 1/2003
DE G 79 29 844.5 3/1981
DE 32 28 491 A1 2/1984
DE 33 09 162 A1 9/1984
DE 33 25 336 1/1985
DE 8623004 10/1986
DE 37 43 083 A1 6/1989
DE G 90 10 066.2 10/1991
DE G 91 14 371.3 4/1992
DE 4038262 6/1992
DE 19630286 1/1998
DE 10110581 11/2001
DE 10124216 1/2002
EP 0 170 720 2/1986
EP 0 215 619 A2 3/1987
EP 0 827 710 A2 3/1998
EP 0 853 917 7/1998
EP 0914795 A2 12/1999
EP 1 070 478 1/2001
EP 1 224 898 7/2002
EP 1 279 362 1/2003
FR 2603181 6/1987
GB 857580 12/1960
GB 990065 4/1965
GB 1201841 8/1970
GB 2035787 A 6/1980
GB 2137896 10/1984

| | | | |
|---|---|---|---|
| GB | 2155314 | | 9/1985 |
| GB | 2189382 | A | 10/1987 |
| GB | 2268875 | | 1/1994 |
| GB | 2291790 | | 7/1994 |
| GB | 2 349 105 | | 10/2000 |
| GB | 2 372 434 | | 8/2002 |
| GB | 2398486 | A | 8/2004 |
| GB | 2413942 | | 11/2005 |
| JP | 54-100149 | | 8/1979 |
| JP | 3-267032 | | 11/1991 |
| JP | 4364822 | | 12/1992 |
| JP | 2000-070198 | | 3/2000 |
| JP | 2001-095735 | | 4/2001 |
| JP | 2001353110 | | 12/2001 |
| JP | 2002 085297 | A | 3/2002 |
| JP | 2002 136456 | A | 5/2002 |
| JP | 2003 275154 | A | 9/2003 |
| SE | 514314 | C2 | 3/1998 |
| SE | 510283 | C2 | 10/1998 |
| WO | WO 97/20492 | | 6/1997 |
| WO | WO 03/009736 | | 2/2003 |
| WO | WO 2004/069021 | | 8/2004 |
| WO | WO 2005/111084 | | 11/2005 |

OTHER PUBLICATIONS

Fakir product pages catalogue, 2002 (5 pages).

Black & white printouts of http://www.igia.com/prodetail.cfm?ID=AT7290 "IGIA Vac Blue" 2002 (3 pages).

Black & white printouts of http://www.igia.com/prodetail.cfm?ID=AT7691 "Wind Storm Wet/Dry Vacuum" 2002 (1 page).

Black & white printouts of http://www.igia.com/prodetail.cfm?ID=AT7739 "Wind Storm Vacuum" 2002 (3 pages).

Black & white printouts of http://www.sewserg.com/products/abp02698.html Miele S147 Little Giant Plus Vacuum Cleaner with Free 5 YR Extended Warranty/Replacement 2004 (3 pages).

Black & white printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds" 2004 (3 pages).

Black & white printouts of http://www.zweita.net/ "Product Info" 2003 (3 pages).

* cited by examiner

DIRT SEPARATOR SYSTEM FOR A VACUUM CLEANER

The invention relates to improvements in vacuum cleaners in order to reduce air flow losses in air passages through a vacuum cleaner.

BACKGROUND OF THE INVENTION

The suction efficiency of a vacuum cleaner is determined, besides by the effective power of the electric motor, also to a large extent by the suction effect losses or air flow losses in the air passages through the vacuum cleaner.

Avoiding air flow losses in the air passages is important in all kinds of vacuum cleaners in order to achieve a high suction efficiency and reduce energy consumption. However, it is especially important in vacuum cleaners having an electrical motor powered by batteries. In such a case it is not a preferred option to compensate for air flow losses in the air passages by increasing the motor power, since this will have the effect that the battery power will be used up in a shorter time, necessitating more frequent recharging. As an alternative, the battery power capacity could be increased by providing more batteries in the vacuum cleaner, but this will have the effect that the costs and the weight of the vacuum cleaner also will increase.

Battery powered vacuum cleaners are known in many different embodiments. The most common type of battery powered vacuum cleaners are small hand held units used for easy cleaning of kitchens, motor cars and the like. Due to the battery operation, which eliminates the need for connecting a mains supply cable, it is possible to perform, for example, daily cleaning of a kitchen swiftly and easily. There are also known battery powered vacuum cleaners of a stick-formed type, having a nozzle device in a lower end and a handle in an upper end, by means of which it is possible to vacuum clean floors for example. There are also known battery powered vacuum cleaners being a combination of these two types, that is, a so called 2-in-1 vacuum cleaner comprising a hand held unit which optionally can be inserted into an elongated support body to form a stick-type vacuum cleaner having a nozzle device in a lower end and a handle in an upper end, by means of which, for example, floors easily can be vacuum cleaned, whereas the hand held unit also can be used separately to vacuum clean, for example, tables, worktops or narrow spaces. In this latter type of vacuum cleaner, all of the machinery, such as the motor, fan unit, batteries and debris collector, is positioned inside the comparatively small hand held unit, whereas the support body only functions as a carrier for the hand held unit when vacuum cleaning floors. As a consequence, the available space for the machinery is limited at the same time as the air must be drawn a comparatively long distance from the nozzle device in the lower end of the support body, through the air passages inside the same, and through the hand held unit.

SUMMARY OF THE INVENTION

It is an exemplary object of the invention to improve the suction efficiency by reducing the air flow losses in the air passages of a vacuum cleaner.

According to a first exemplary aspect of the invention, it is an object to improve the suction efficiency through the air passages of a vacuum cleaner of a hand held unit type. At least this object may be achieved by a vacuum cleaner according to claims 6, 7, 8 and 11.

According to a second exemplary aspect of the invention, it is an object to improve the suction efficiency through the air passages of a stick formed vacuum cleaner. At least this object may be achieved by a vacuum cleaner according to claims 1, 6, 7, 8 and 12.

According to a third exemplary aspect of the invention, it is an object to improve the suction efficiency through the air passages of a vacuum cleaner of a so called 2-in-1 type comprising a hand held unit and a support body, in which the hand held unit is insertable in order to optionally use the hand held unit separately or as a stick-type vacuum cleaner. At least this object may be achieved by a vacuum cleaner according to claims 1, 3, 6, 7, 8, 12 and 13.

According to a fourth exemplary aspect of the invention, it is an object to improve the suction efficiency through the air passages of a vacuum cleaner having a cyclone-like type of debris collector. At least this object may be achieved by a vacuum cleaner according to claims 6, 7 and 8.

BRIEF DESCRIPTION OF THE DRAWINGS

An exemplary embodiment will now be described in the form of a so-called 2-in-1 vacuum cleaner, with reference to the drawings, in which.

DETAILED DESCRIPTION OF AN EXEMPLARY EMBODIMENT OF THE INVENTION

Figure 1:
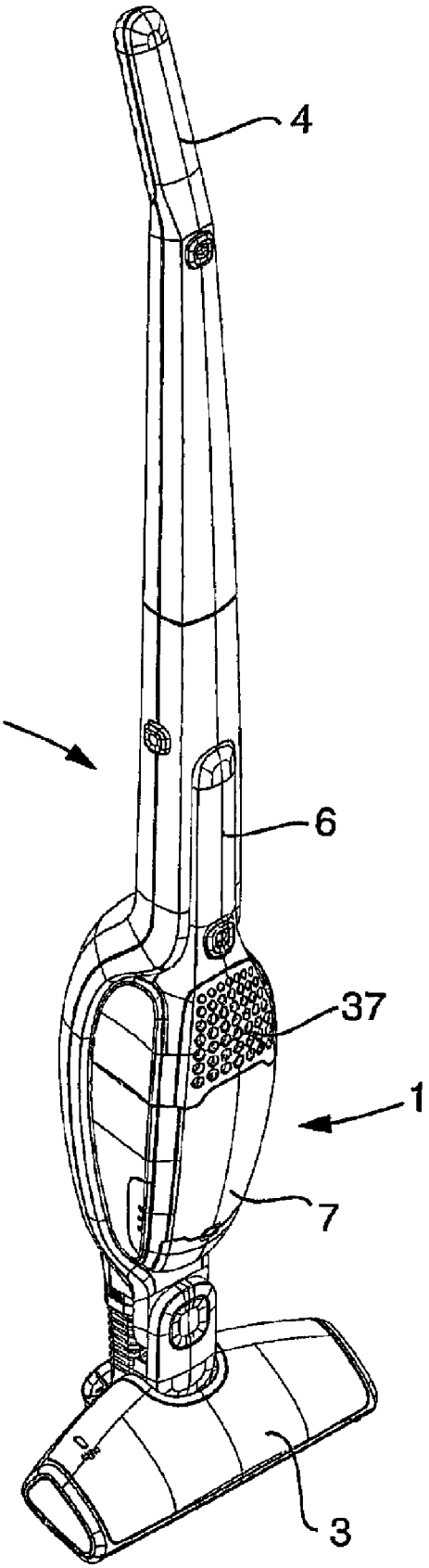
FIG. 1 is a perspective view of a stick-formed vacuum cleaner of a 2-in-1 type.
Figure 2:
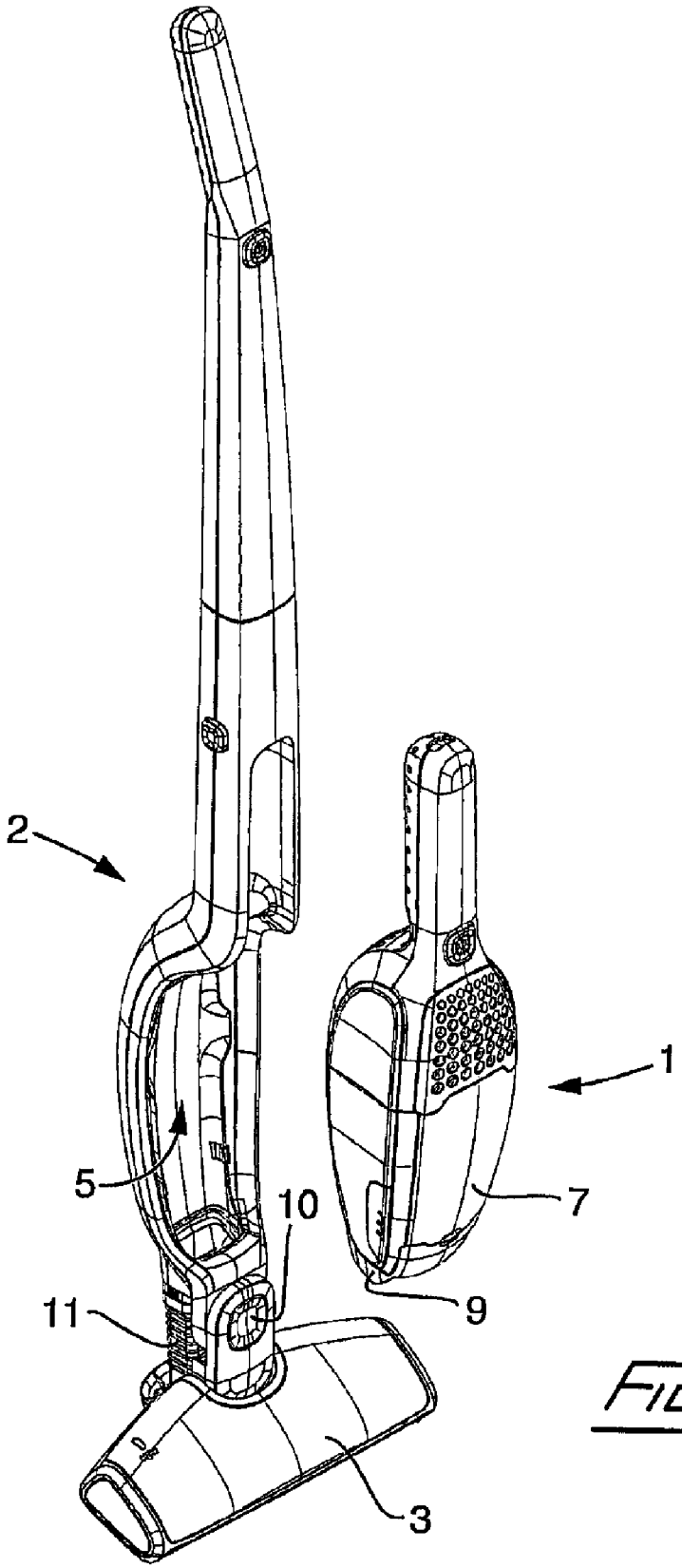
FIG. 2 is a perspective view of the vacuum cleaner according to FIG. 1, with a hand held unit released from a stick-formed support body.

A vacuum cleaner of a 2-in-1 type, is shown in FIG. 1 in an assembled state and in FIG. 2 with a hand held unit 1 released from a stick-formed support body 2. The support body 2 comprises a nozzle device 3 in a lower end, a handle 4 in an upper end, and a recess 5 for accommodating the hand held unit 1. The hand held unit comprises an electrical motor, chargeable batteries, a fan unit driven by the electrical motor, a handle 6 and a cyclone-like separator including a debris container 7 for collecting debris and dust. The nozzle device 3 is of an ordinary, previously known kind, by means of which floors can be vacuum cleaned when the hand held unit 1 is inserted in the support body 2, in which case air is drawn by the fan unit from the nozzle device 3, through an air passage 8 in the support body 2, and into the hand held unit. When, on the other hand, the hand held unit is released from the support body, the hand held unit can be used separately to vacuum clean, for example, tables, worktops or narrow spaces. In this case, air and debris is drawn through a tube-shaped inlet 9. The inlet tube 9 can be connected to various nozzle adapters to facilitate vacuum cleaning of different surfaces.

Figure 3:
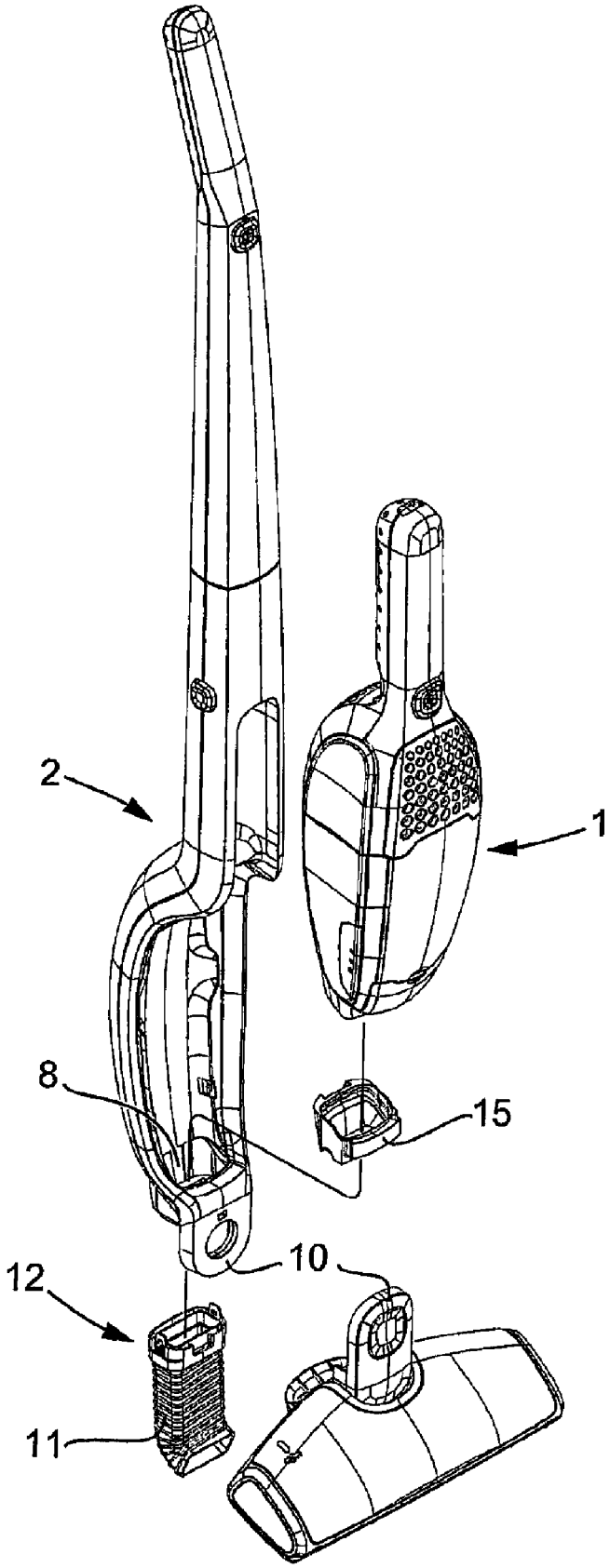
FIG. 3 is an illustration of the mechanical and pneumatic connection between the nozzle device, the support body and the hand held unit.

Reference is now made to FIG. 3 in which is shown the support body 2 and the nozzle device 3 in a disassembled state. In the assembled state the support body 2 and the nozzle device 3 are connected by means of an articulated joint 10 such that the nozzle device can be rotated in relation to the support body during vacuum cleaning. To allow air flow from the nozzle device 3 to the air passage 8 in the support body 2, a flexible hose 11 is connected between the nozzle device and the support body.

Generally, air flow losses in vacuum cleaners can be reduced by: avoiding abrupt contractions or enlargements, changes of the cross sectional shape or sharp direction changes of air passages; avoiding leakage of outside air into the air passages; and preventing clogging of debris in the air passages. In order to render stick-type vacuum cleaners compact, smooth and easy to control during use and cost-effective to manufacture, it is known to attach the nozzle device in a lower end mechanically by means of an articulated joint and pneumatically by means of a flexible hose, preferably in the area behind the articulated joint in order to hide the flexible hose as well as possible behind the articulated joint. Traditionally, this flexible hose has an oval or circular cross section. In order to make the appearance of the flexible hose as discrete as possible, the maximum width of the flexible hose may be restricted. Since the cross section is oval or circular, this has the effect that the cross sectional area of the flexible hose becomes unnecessarily restricted, which increases the air flow losses through the flexible hose.

According to exemplary embodiments of the invention, the flexible hose 11 may have a generally rectangular cross sectional shape. In this way the flexible hose 11 can be made with a comparatively large cross sectional area and still, to a large extent, be hidden behind the articulated joint. This contributes to an attractive appearance of the vacuum cleaner while minimizing the air flow losses. In embodiments in which the air passage 8 in the support body also has a general rectangular cross section, this also has the effect that there will be small or substantially no air flow losses due to changing cross sectional shapes between the nozzle device and the air passage. In the exemplary embodiment, the available space behind the articulated joint may be utilized effectively to the utmost possible extent to hide the flexible hose behind the articulated joint and, at the same time, provide an air passage having a comparatively large cross sectional area. A rectangular or square hose will also be thinner, from a front side to a rear side, than an oval or circular hose having the same cross sectional area. This is advantageous, for example, when vacuum cleaning in narrow spaces under furniture. With a thinner hose it is also possible to lower the articulated joint between the nozzle device and the support body, which likewise facilitates access under furniture. Another advantage is that the movability of the nozzle is increased since the rectangular hose is less likely to contact the floor than an oval circular hose due to the concave walls thereof.

As mentioned before, it is advantageous to maintain substantially the same shape and cross sectional dimension of the air passages at least to the debris collector for the purpose of lowering the air flow losses. By forming the flexible hose with a rectangular or square cross section, it is easier to achieve this object since it normally is more favorable to form the air passages in the support body with a rectangular cross section. In addition, though it is a disadvantage, in respect of restricting the air flow losses, to have air passages with too small cross sectional dimensions, it is also a disadvantage if they are to big. It has been found, according to one embodiment of the invention, that a cross sectional dimension of the air passages between 1.085 to 0.465 square inches ($in^2$) (i.e., 0.07-0.03 square decimeters ($dm^2$)) is optimal for an air flow of between 1098 to 427 cubic inches per second ($in^3$/sec) (i.e., 18-7 liters per second (l/sec)). This is due to the fact that the air flow rate must be sufficiently high to be able to perform vacuum cleaning with a good result.

In order to reduce air flow losses in the air passages, it is also important to prevent clogging of debris in the air passages. However, if any debris should nevertheless get stuck in the air passages, it is advantageous if the vacuum cleaner is constructed such that the debris can easily be removed. Accordingly, in one embodiment of the invention, the flexible hose may be attached to the support body and/or to the nozzle device by a quick release arrangement such that at least one end of the flexible hose easily can be released and any stuck debris can be removed from the hose.

Figure 4:
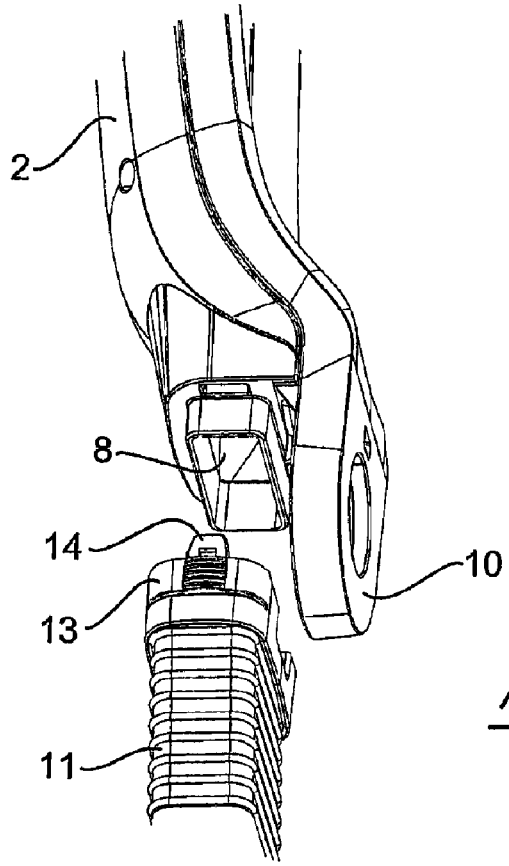
FIG. 4 is a perspective view in an enlarged scale of the connection between a flexible hose and the support body.

In the shown exemplary embodiment, the upper end of the flexible hose 11 is attached to the support body 2 by means of a quick release fitting 12, which facilitates removing debris that may possibly stick in the flexible hose and eliminates the risk of air flow losses for this reason. The quick release fitting 12 is illustrated in more detail in FIG. 4, in which it is shown that the upper end of the hose 11 is provided with a rigid collar 13 that includes resilient tabs 14 having holes that can go into engagement with matching protrusions on the support body 2.

In the case of a so called 2-in-1 vacuum cleaners having a small hand held unit, which is insertable in a support body, it has been found that one weak point for air flow losses is the connection between the hand held unit, that is, the tube-shaped air inlet of the hand held unit, and the air passage from the nozzle in the support body. To reduce air flow losses it is beneficial that as little air as possible can be drawn from the outside through this connection and into the air passage. At the same time the hand held unit must be easily and readily releasable from the support body to enable vacuum cleaning with the hand held unit alone. In one embodiment of the invention the connection may be formed by an annular shoulder in the support body, being adapted to abut against the annular rim of the tube-shaped air inlet at the hand held unit, and a bead that is adapted to abut against the outer surface of the air inlet at least partially around its circumference. As explained below, the connection may be formed by an insert sleeve, having an annular shoulder as well as a bead, that is mounted in the air passage in the support body. However, it would also be possible to provide a connection by means of a separate bead-forming element, for example a bead-forming element that is mounted in a circumferential groove in the air passage, and a separate sealing element being positioned on an annular shoulder in the air passage. In order to ensure convenient releasing of the hand held unit from the support body, it may be suitable to provide the sealing bead only partly around the circumference of the tube-shaped air inlet. Preferably, the insert sleeve, or separate bead and sealing elements, are formed of a material that is at least slightly resilient to ensure sealing abutment against the air inlet tube of the hand held unit.

Figure 5:
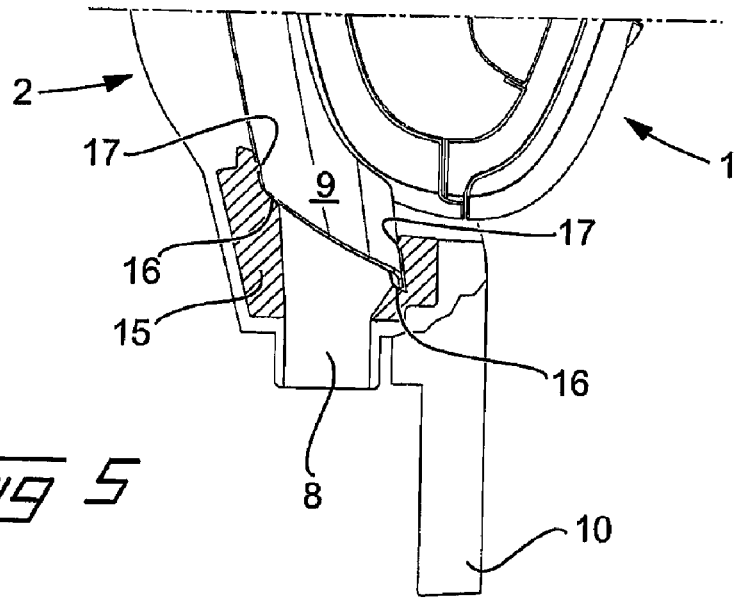
FIG. 5 is a partially cut away view of the connection between an inlet tube of the hand held unit and an air passage in the support body.

FIGS. 3 and 5 illustrate an exemplary embodiment of a connection between the inlet tube 9 of the hand held unit 1 and the air passage 8 in the support body 2. As can be seen, the hand held unit is selectively mounted in the recess 5 such that the inlet tube 9 of the hand held unit is inserted into the air passage 8. To minimize air leakage between the inlet tube 9 and the air passage 8, a sealing collar 15 of a resilient material is mounted in the air passage 8. FIG. 5 illustrates, in greater detail, the shape of the exemplary sealing collar 15, which is shown in cross section in the area of the connection between the inlet tube 9 of the hand held unit 1 and the air passage 8 of the support body 2. According to one embodiment of the invention, the sealing collar may be formed with a stepped shoulder surface 16, which is adapted to abut the circumferential rim of the inlet tube 9. The inner surface of the sealing collar 15 also may be be provided with a bead 17, which is adapted to bear against the outer surface of the inlet tube 9 at, for example, a location further along the direction of the airflow past the shoulder surface 16. In this way adequate sealing of the inlet tube, which restricts the air leakage into the inlet tube through the connection between the air passage 8 and the inlet tube 9, may be achieved. To facilitate releasing and mounting of the hand held unit in the support body, the bead 17 may be discontinuous and be missing in certain portions around the circumference of the inner surface of the sealing collar, such as at locations along the rear surface of the sealing collar. In such a case a bead in the front surface can be utilized, due to its resilient characteristics, to press the inlet tube of the hand held unit against the rear surface of the sealing collar, which also is of a resilient material, such that an adequate sealing effect is achieved.

Battery powered vacuum cleaners and especially hand held units, are often equipped with a debris collector in form of a cyclone-like separator to separate the debris from the air flow. One main reason for this is that the available space in the debris collector of battery powered vacuum cleaners is too small for bags of ordinary size, and would necessitate an unwanted frequent replacement of bags. It has been found that the shape of the air channel and the inlet opening to the cyclone-like separator can be important for reducing the air flow losses in the vacuum cleaner. According to one exemplary embodiment of the invention, the air passage from the air inlet of the hand held unit may be curved and have an inlet opening into the cyclone-like separator that is positioned off-center in relation to the symmetry plane of the cyclone-like separator. In this arrangement, the air flow enters the cyclone-like separator substantially in the tangential direction in the upper periphery of the cyclone-like separator. Thereby direction changes of the air passage at the inlet opening into the cyclone-like separator are reduced, and air flow losses are lowered.

Figure 6:
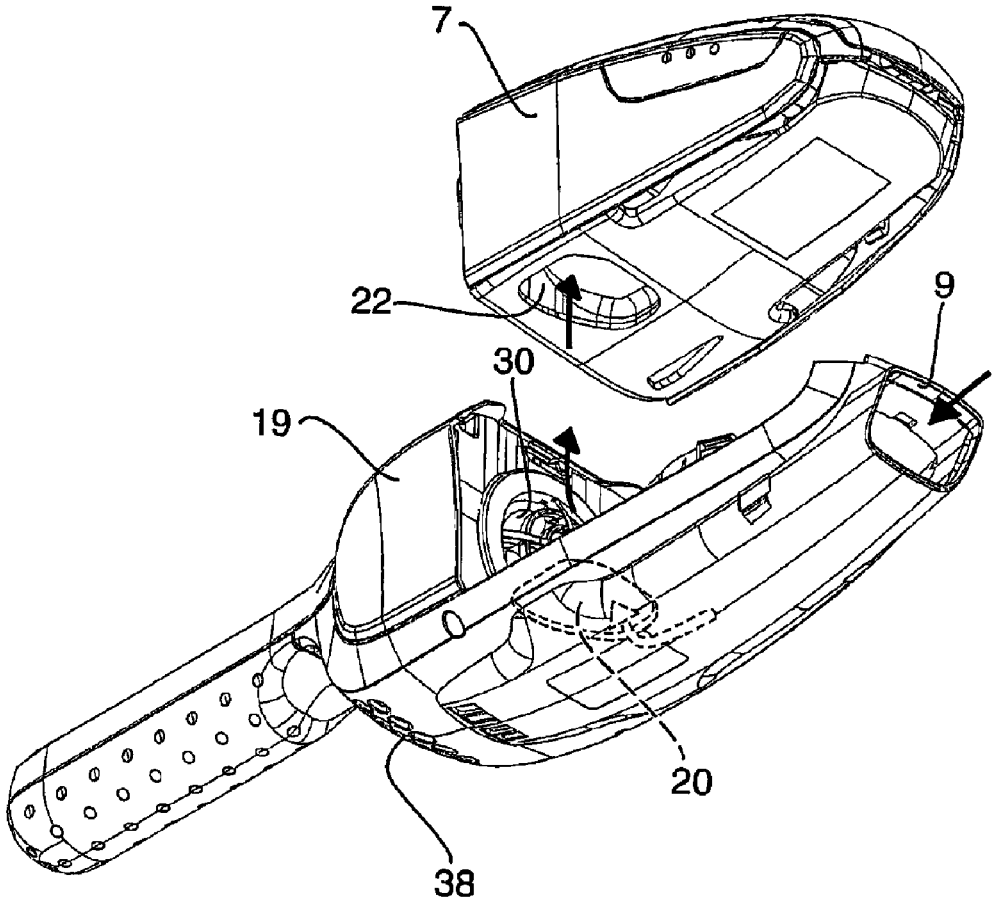
FIG. 6 is a perspective view from below of the hand held unit with a debris container released.
Figure 7:
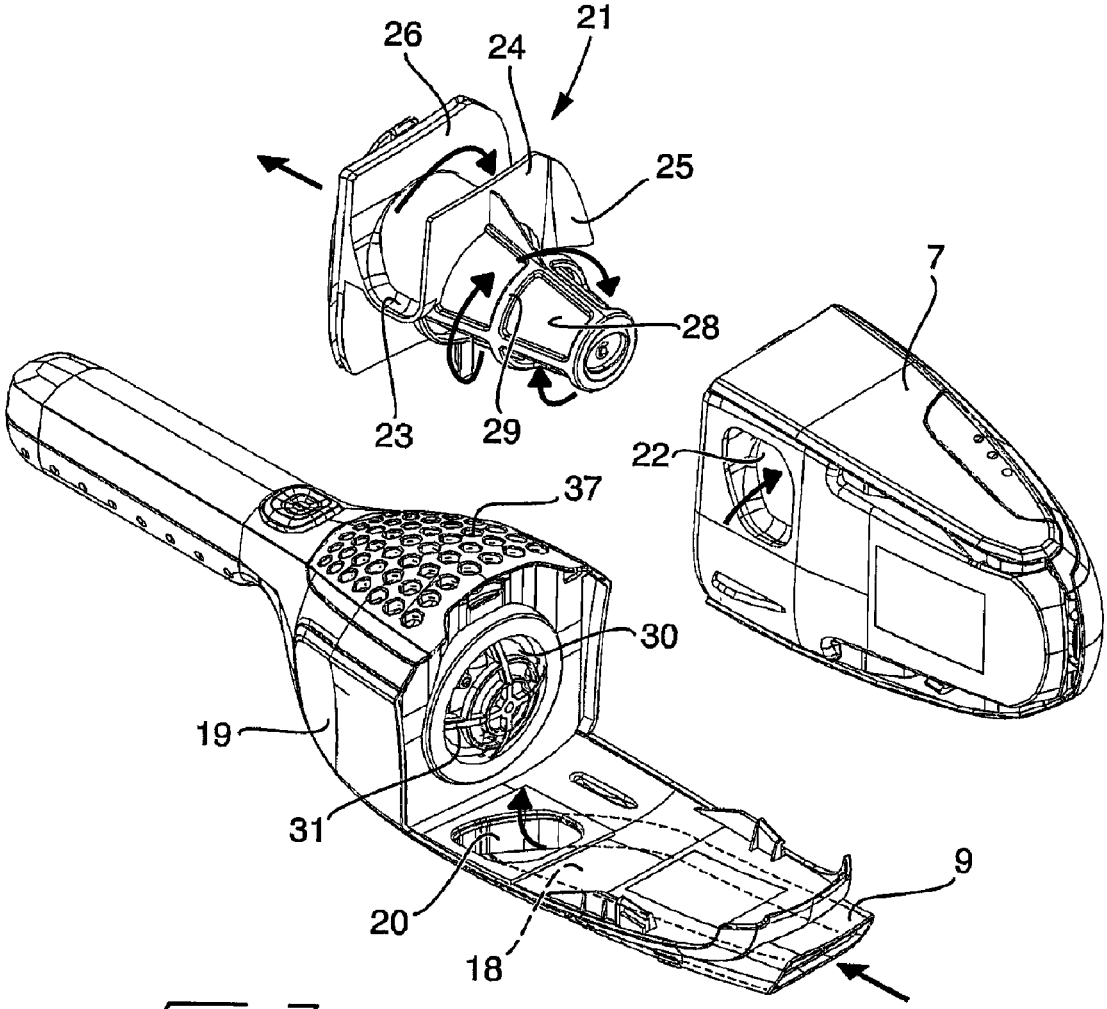
FIG. 7 is a perspective view from above of the hand held unit with the debris container released and rotated, and a filter insert withdrawn from the debris container.

An example of the foregoing embodiment is illustrated in FIGS. 6 and 7, which are perspective views of the hand held unit shown from the bottom side and from the upper side, respectively, with the debris container 7 released from a base unit 19 of the hand held unit.

To restrict the air flow losses in the hand held unit from the inlet tube 9 to the cyclone-like separator, an air channel 18 in the hand held unit has, according to this exemplary embodiment of the invention, been formed with a curved shape. The broken lines indicate the extension of the air channel 18 and an outlet opening 20 to the debris container 7. In FIG. 7 a filter insert 21 is shown withdrawn from inside the debris container 7. The debris container 7 and the filter insert 21 form the cyclone-like separator of the hand held unit. During operation the air flows in through the inlet tube 9, passes through the curved air channel 18 in the base unit 19, exits the outlet opening 20 in the base unit and enters an inlet opening 22 in the debris container. The air channel 18 is curved in such a way that the outlet opening 20 and inlet opening 22 are positioned off centre in respect of a symmetry plane of the hand held unit and the air flow enters the debris container directed substantially tangentially with respect of the periphery of the inner surface of the debris container 7 and the outer surface of the filter insert 21 (as is illustrated by the flow arrows in the figures).

To direct the air flow inside the cyclone-like separator, there may be provided a partition wall between the filter insert and the inner surface of the debris container. This partition wall may extend from the inlet opening of the cyclone-like separator to preferably at least about one quarter to half the distance around the filter insert. At an end portion distant from the inlet opening, the partition wall may be curved in the direction towards an end of the filter insert, in order to smoothly direct the air flow helically around the filter insert.

An exemplary embodiment of a partition wall is shown in FIG. 7, in which the filter insert 21 is provided with partition walls 23, 24 which, when the filter insert is mounted in the debris container 7, extend between the outer filter surface, which is elongated with a substantially circular cross section and positioned centrically in the debris container, and the inner surface of the debris container 7. More precisely the partition walls comprise a first semi-circular partition wall 23, which restricts air from passing in the undesired direction from the inlet opening 22, and one second straight partition wall 24, which directs the air flow circumferentially around the filter in the desired direction. According to the invention, the straight partition wall 24 is provided, in an end distant from the inlet opening 22, with a curved directing portion 25, which is curved in the direction toward an end of the filter and directs the air flow helically around the filter insert. Also, an end wall 26 of the filter insert 21 which, when the filter insert is mounted in the debris container 7, forms an end wall of the debris container, may have a curved directing portion in the vicinity of the end portion of the partition wall to further direct the air flow helically around the filter insert. For example, the end wall 26 may be provided with a curved directing portion 27 (shown in FIG. 8), which is curved like the curved directing portion 25 of the partition wall 24, in the direction toward the end of the filter and has the purpose of contributing to helically directing the air flow.

Figure 8:
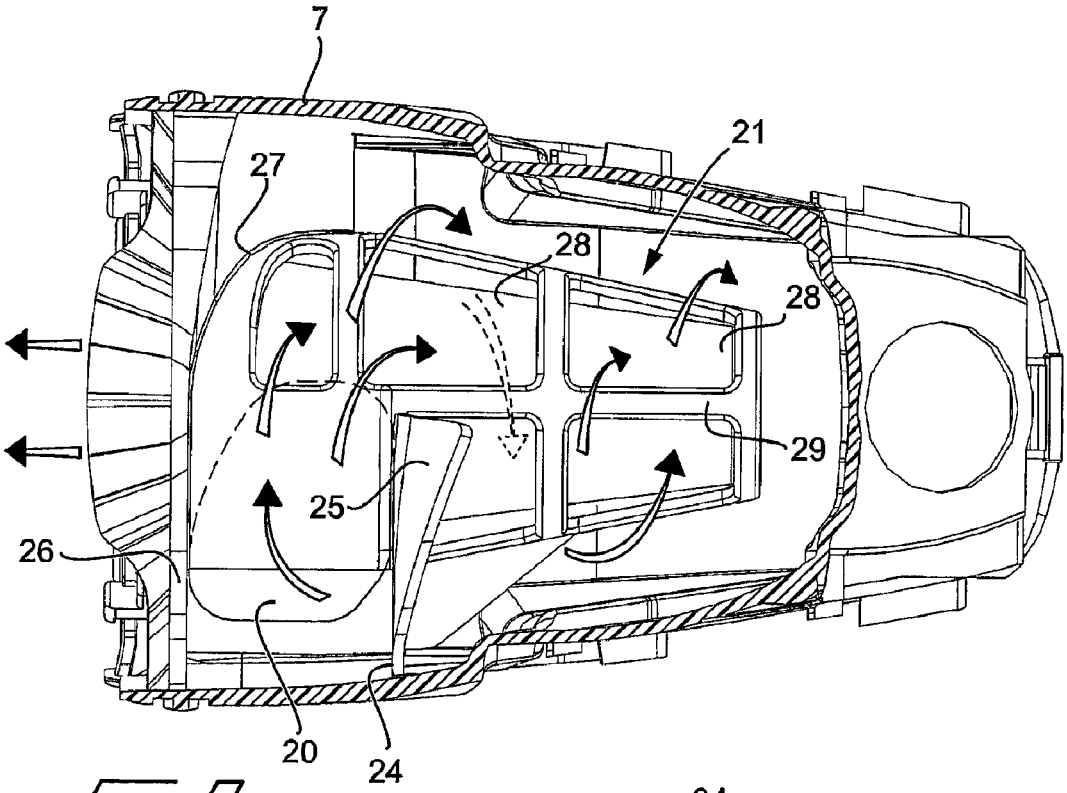
FIG. 8 is a partially cut away view of the debris container from above showing the filter insert and the air flow inside the debris container.

The air flow around the filter insert is further illustrated in FIG. 8 by arrows. As can be seen, the filter is provided with several filter panels 28 in a supporting frame structure 29 made of an airtight material, such as plastics. While the air flows helically around the filter, it gradually enters radially through the filter panels 28 and subsequently flows in the axial direction inside the filter insert to the fan unit, which is positioned inside the base unit 19. The filter insert also may be provided with filter material, such as panels 28, for the passage of air through the filter and into the filter insert, at a portion thereof that follows the portion that starts the cyclonic rotation of the air. Thereby the filter area is increased as compared with prior art filter inserts, which has the effect that the air flow losses over the filter insert are reduced.

In the shown exemplary embodiment, the parts form an air passage between the filter, the inner surface of the debris container, an end wall of the debris container and the partition wall 24, which may have substantially the same shape and cross sectional area dimension as the air passage 18 through the support body. In the shown embodiment, this passage is substantially rectangular, has mainly the same shape and cross sectional size as the air passage 18 in the support body, is defined between the filter surface, the inner surface of the debris container, an end wall of the debris container and the partition wall, and extends about a quarter to half of the distance around the filter insert. This may be advantageous with respect to restricting air flow losses and maintaining a sufficient air flow rate, as mentioned before, and creates a favorable air flow inside the cyclone-like separator.

After passing through the filter insert in the cyclone-like separator, the air flow is passed to the motor-fan unit through an inlet opening. According to an exemplary embodiment of the invention, the inlet opening to the motor-fan unit may be funnel-shaped in order to reduce air flow losses when the air flow is transferred from the cyclone-like separator to the motor-fan unit after passage through the filter insert. Further, according to regulations in most countries, the inlet opening to the motor-fan unit has to be covered by an intake screen to prevent physical injuries from the rotating fan. In order to reduce air flow losses, the intake screen may be formed with a domed shape. This is beneficial for the reduction of air flow losses in two different ways. On the one hand, this has the effect that the area of the intake screen will become larger such that the total area of the air flow openings through the intake screen can be made larger. On the other hand this has also the effect that the intake screen will become stronger, due to the dome-shape, which can be utilized to reduce the cross-sectional dimensions of individual screen members, which also will reduce the air flow losses through the intake screen.

Figure 9:
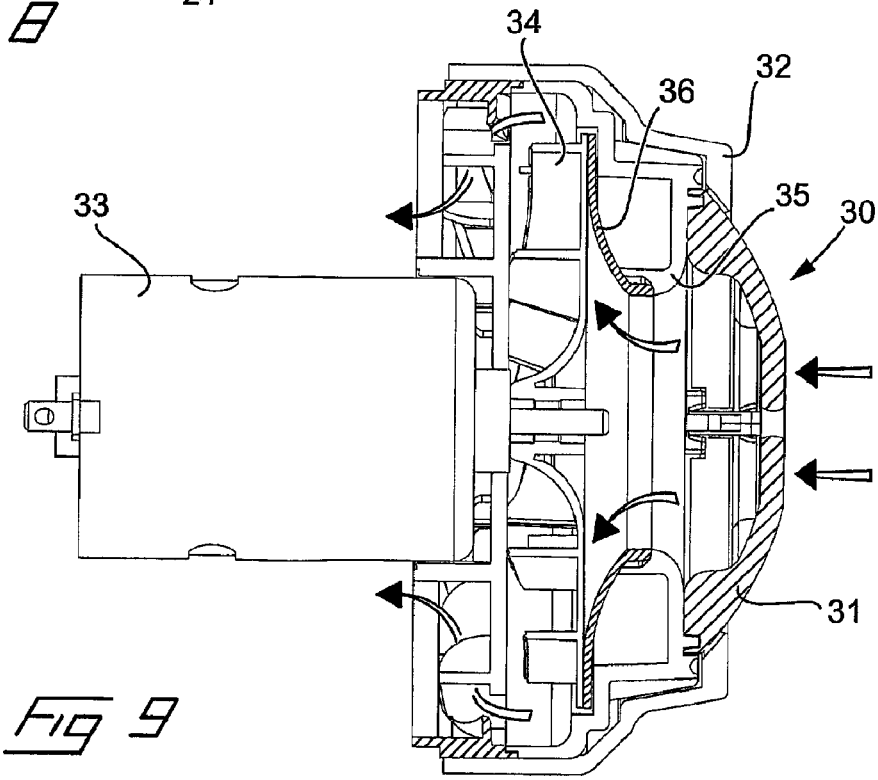
FIG. 9 is a partially cut away view through an intake screen and an inlet opening to a motor and a fan unit.

FIGS. 6 and 7 illustrate an exemplary embodiment of an inlet opening 30 to the fan unit inside the hand held unit. The inlet opening 30 is covered by an intake screen 31 to prevent physical injuries from the rotating fan. The inlet opening is formed by an insert collar 32 which, together with the intake screen 31, a motor 33 and a fan wheel 34, is shown in a cross sectional view in FIG. 9. To restrict the air flow losses trough the inlet opening 30, it has been formed with a smoothly rounded, tapering funnel portion 35 and a smoothly rounded, widening portion 36 leading to the fan wheel 34, as can be seen from the Figure. In this way, unnecessary turbulent flow due to abrupt dimension changes when transferring the air from the cyclone-like separator to the fan unit may be avoided. Moreover, the intake screen 31 is formed with a dome shape. As noted above, this has the effect that the total area of the air flow openings through the intake screen can be made larger, and also makes the intake screen stronger to resist forces acting in a perpendicular direction towards the dome. This additional strength can be utilized to reduce the cross-sectional dimensions of individual screen members.

To reduce the air flow losses through a vacuum cleaner, it also may be important not to unnecessarily slow down the air flow through the air exhaust section from the fan unit. Therefore, in one exemplary embodiment of the invention, the vacuum cleaner may be provided with a first air outlet on a front side as well as a second air outlet on a rear side. This feature can be incorporated in a hand held unit, in a stick formed vacuum cleaner, as well as in a 2-in-1 type of vacuum cleaner. In the latter case the hand held unit is provided with a first air outlet in the front side and a second air outlet in the rear side, whereas the support body is provided with air flow openings in the rear side of the recess for accommodating the hand held unit, which substantially coincide with the second air outlet.

Figure 10:
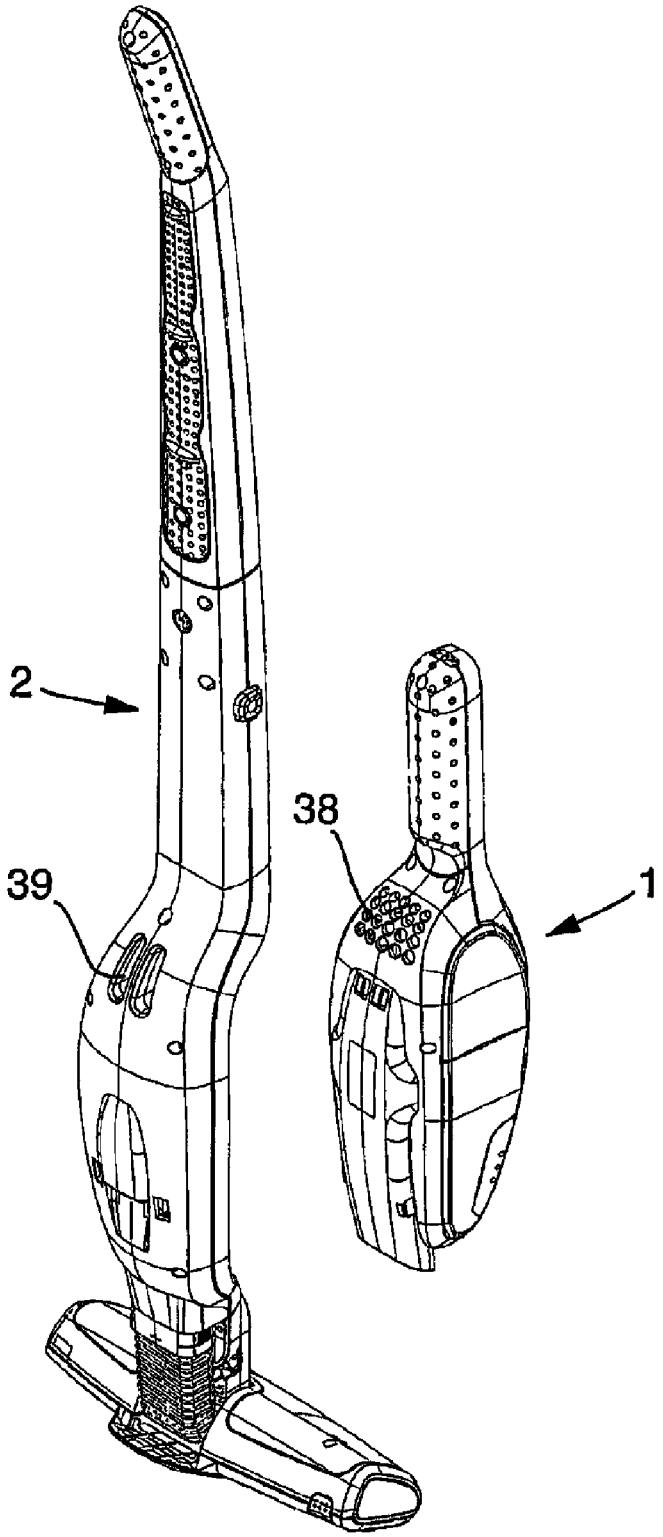
FIG. 10 is a perspective view from behind of the vacuum cleaner with the hand held unit released.

An exemplary example of the foregoing arrangement is shown in the Figures. According to this exemplary embodiment of the invention, the hand held unit is provided with a first air outlet 37 on the front side as well as a second air outlet 38 on the rear side, as can be seen, for example, from FIGS. 1 and 10, respectively. In order to reduce the air flow resistance when the hand held unit is mounted in the support body 2, the rear side of the support body, in the region of the recess 5 for accommodating the hand held unit 1, is provided with air flow openings 39 to allow air flow from the second air outlet 38 to the environment through the air flow openings 39 in the support body. In case of a stick formed vacuum cleaner, which is not provided with a separate releasable hand held unit, as in the described embodiment, the vacuum cleaner can be provided with a similar second air outlet 39 on the rear side.

It is to be understood that it is within the scope of the invention that all the features, mentioned in this specification, for reducing air flow losses through a vacuum cleaner, can be applied separately in a vacuum cleaner or in any combination. It will also be understood that variations to the foregoing exemplary embodiments may be made without departing from the spirit of the inventions described herein, and the description of various exemplary embodiments is not intended to limit the scope of the invention.

We claim:

1. A cyclone separator for a vacuum cleaner, the cyclone separator comprising:

a debris container having an open end, a closed end, a sidewall extending from the open end to the closed end, and a cyclone inlet through the sidewall;

a filter insert having an end wall adapted to abut the open end of the debris container on a first side of the cyclone inlet, a cyclone outlet through the end wall, and a filtering portion extending inside the debris container from the end wall to a point past the cyclone inlet, the filtering portion comprising one or more filters through which air can pass to travel from the cyclone inlet to the cyclone outlet;

a partition wall extending from the filter insert towards the sidewall on a second side of the cyclone inlet, the second side being opposite the first side such that the cyclone inlet is located between the end wall and the partition wall;

a first directing portion extending from the partition wall towards the closed end of the debris container; and a second directing portion extending from the end wall towards the closed end of the debris container;

wherein the first directing portion and the second directing portion direct airflow in the dirt container in a helical direction around the filter insert.

2. The cyclone separator of claim 1, wherein the first directing portion is adapted to direct cyclonic airflow moving between the partition wall and the closed end of the dirt container in a helical direction around the filter insert.

3. The cyclone separator of claim 1, wherein the second directing portion is adapted to direct cyclonic airflow moving between the partition wall and the end wall in a helical direction around the filter insert.

4. The cyclone separator of claim 1, wherein the filtering portion comprises one or more filter panels.

5. The cyclone separator of claim 1, wherein the filtering portion comprises a frame structure having one or more filter panels secured thereto.

6. The cyclone separator of claim 1, wherein the filter insert is removably connected to the debris container.

7. The cyclone separator of claim 1, wherein the partition wall extends at least about one quarter to half a distance around the filter insert.

8. The cyclone separator of claim 1, wherein first directing portion is curved.

9. The cyclone separator of claim 1, wherein second directing portion is curved.

10. The cyclone separator of claim 1, wherein the partition wall is integrally formed with the filter insert and extends from the filter insert to an inner surface of the debris container.

11. The cyclone separator of claim 1, further comprising a connecting wall extending from the end wall to the partition wall proximal to the cyclone inlet to restrict air from passing between the filter insert and the debris container at the location of the connecting wall.

12. The cyclone separator of claim 11, wherein the connecting wall comprises a curved wall.

13. The cyclone separator of claim 11, wherein the end wall, the partition wall, and the connecting wall form a cyclone passage between the filter insert and an inner surface of the debris container.

14. The cyclone separator of claim 13, wherein the cyclone passage extends around about a quarter to half a distance around the filter insert.

15. The cyclone separator of claim 13, wherein the cyclone passage has a cross sectional shape that matches an inlet air passage connected to the cyclone inlet.

16. The cyclone separator of claim 15, wherein the inlet air passage and the cyclone passage are generally rectangular.

17. A vacuum cleaner comprising:

a base having a dirty air inlet formed therein;

a directing handle connected to the dirty air inlet;

an air path extending from the dirty air inlet to a fan and associated motor, the fan and associated motor being adapted to selectively generate a working air flow into the dirty air inlet and through the air path;

a debris container selectively positioned in the air path, the debris container having an open end, a closed end, a sidewall extending from the open end to the closed end, and a cyclone inlet through the sidewall;

a filter insert having an end wall adapted to abut the open end of the debris container on a first side of the cyclone inlet, a cyclone outlet through the end wall, and a filtering portion extending inside the debris container from the end wall to a point past the cyclone inlet, the filtering portion comprising one or more filters through which air can pass to travel from the cyclone inlet to the cyclone outlet;

a partition wall extending from the filtering portion towards the sidewall on a second side of the cyclone inlet, the second side being opposite the first side such that the cyclone inlet is located between the end wall and the partition wall;

a first directing portion extending from the partition wall towards the closed end of the debris container; and a second directing portion extending from the end wall towards the closed end of the debris container;

wherein the first directing portion and the second directing portion direct airflow in the dirt container in a helical direction around the filter insert.

18. The vacuum cleaner of claim 17, further comprising a connecting wall extending from the end wall to the partition wall proximal to the cyclone inlet to restrict air from passing between the filter insert and the debris container at the location of the connecting wall.

19. The cyclone separator of claim 18, wherein the end wall, the partition wall, and the connecting wall form a cyclone passage between the filter insert and an inner surface of the debris container.

20. The cyclone separator of claim 19, wherein the cyclone passage extends around about a quarter to half a distance around the filter insert.

21. The cyclone separator of claim 17, wherein:

the debris container is mounted along a lateral centerline of the directing handle and the cyclone inlet is offset from the lateral centerline of the directing handle; and a first part of the air path fluidly connects the dirty air inlet to the cyclone inlet;

wherein at least a portion the first part of the air path is offset from the lateral centerline of the directing handle to selectively connect to the cyclone inlet.

* * * * *